US008316947B2

(12) United States Patent
Sack

(10) Patent No.: US 8,316,947 B2
(45) Date of Patent: Nov. 27, 2012

(54) SYSTEM AND METHOD FOR DEPLOYMENT OF A SUBSEA WELL INTERVENTION SYSTEM

(75) Inventor: Daniel Sack, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 171 days.

(21) Appl. No.: 12/535,417

(22) Filed: Aug. 4, 2009

(65) Prior Publication Data

US 2010/0038091 A1 Feb. 18, 2010

Related U.S. Application Data

(60) Provisional application No. 61/089,025, filed on Aug. 14, 2008.

(51) Int. Cl.
*E21B 23/00* (2006.01)
*E21B 19/00* (2006.01)

(52) U.S. Cl. ..... 166/345; 166/341; 166/346; 166/352; 166/85.1; 405/168.3; 405/224.3

(58) Field of Classification Search ..... 166/345, 166/336, 339, 341, 344, 346, 350–352, 355, 166/367, 368, 381, 384, 385, 77.1, 77.2, 166/85.1, 85.5, 241.1, 241.5; 405/166, 168.3, 405/168.4, 224.2–224.4
See application file for complete search history.

(56) References Cited

U.S. PATENT DOCUMENTS 3,698,199 A * 10/1972 Matthews, Jr. ..... 405/169
3,724,061 A * 4/1973 Schipper ..... 29/464
4,490,073 A * 12/1984 Lawson ..... 405/169
4,588,326 A * 5/1986 Langner ..... 405/169
4,643,614 A * 2/1987 Laursen ..... 405/169
4,730,677 A * 3/1988 Pearce et al. ..... 166/345
5,671,811 A * 9/1997 Head ..... 166/346
5,749,676 A * 5/1998 Head ..... 405/171
5,778,981 A * 7/1998 Head ..... 166/345
5,890,841 A * 4/1999 Friis et al. ..... 405/170
6,042,303 A * 3/2000 Head ..... 405/195.1
6,161,619 A * 12/2000 Head ..... 166/355
6,276,456 B1 * 8/2001 Head ..... 166/359
6,386,290 B1 * 5/2002 Headworth ..... 166/346
6,588,985 B1 * 7/2003 Bernard ..... 405/191

(Continued)

FOREIGN PATENT DOCUMENTS

WO 01/22577 3/2001

(Continued)

*Primary Examiner* — Thomas Beach
*Assistant Examiner* — Matthew Buck
(74) *Attorney, Agent, or Firm* — Stephanie Chi

(57) ABSTRACT

A method, system and apparatus for deploying a subsea well intervention system from a surface vessel to a subsea tree, including connecting a spoolable compliant guide (SCG) to a subsea intervention package; testing the connection; lowering overboard the intervention package into a water column using a primary lifting device; gradually paying out the SCG from a reel thereof as the intervention package is lowered to a seabed; transferring the weight of the intervention package to a secondary lifting device, wherein the intervention package functions as a dead weight to overcome a positive buoyancy of the SCG, a distance between the primary and secondary lifting devices creates and controls a shape of the SCG; and once landed onto a subsea tree with heave compensation, disconnecting the secondary lifting device from the intervention package, and hanging the SCG off at the vessel at deck level.

13 Claims, 4 Drawing Sheets

U.S. PATENT DOCUMENTS

| | | | | |
|---|---|---|---|---|
| 6,691,775 | B2 * | 2/2004 | Headworth | 166/77.2 |
| 6,745,840 | B2 * | 6/2004 | Headworth | 166/346 |
| 6,752,100 | B2 * | 6/2004 | Guinn et al. | 114/258 |
| 6,834,724 | B2 * | 12/2004 | Headworth | 166/384 |
| 6,843,321 | B2 * | 1/2005 | Carlsen | 166/355 |
| 6,935,262 | B2 * | 8/2005 | Roodenburg et al. | 114/258 |
| 7,011,473 | B2 * | 3/2006 | Tangen et al. | 405/209 |
| 7,191,836 | B2 * | 3/2007 | Bhat et al. | 166/355 |
| 7,416,025 | B2 * | 8/2008 | Bhat et al. | 166/355 |
| 7,520,331 | B2 * | 4/2009 | Bhat et al. | 166/367 |
| 7,600,569 | B2 * | 10/2009 | Routeau et al. | 166/344 |
| 7,628,206 | B2 * | 12/2009 | Bhat et al. | 166/355 |
| 7,748,464 | B2 * | 7/2010 | Bhat et al. | 166/355 |
| 7,770,655 | B2 * | 8/2010 | Wilde et al. | 166/381 |
| 7,798,232 | B2 * | 9/2010 | Headworth | 166/352 |
| 7,845,412 | B2 * | 12/2010 | Sbordone et al. | 166/368 |
| 7,866,398 | B2 * | 1/2011 | Barratt et al. | 166/341 |
| 7,926,579 | B2 * | 4/2011 | Sbordone et al. | 166/384 |
| 2008/0185152 | A1 | 8/2008 | Sbordone et al. | |
| 2008/0185153 | A1 * | 8/2008 | Smedstad et al. | 166/345 |
| 2008/0314597 | A1 | 12/2008 | Sbordone et al. | |
| 2008/0314598 | A1 * | 12/2008 | Rodrigues et al. | 166/342 |

FOREIGN PATENT DOCUMENTS

| | | |
|---|---|---|
| WO | 2008/118680 | 10/2008 |
| WO | 2009/053022 | 4/2009 |

* cited by examiner

SYSTEM AND METHOD FOR DEPLOYMENT OF A SUBSEA WELL INTERVENTION SYSTEM

This application claims the benefit of U.S. Provisional Application No. 61/089,025, filed on Aug. 14, 2008.

BACKGROUND OF THE INVENTION

1. Field of the Invention

The present invention generally relates to methods and systems for well intervention operations in subsea wells, and more particularly to a system and method for deploying a subsea well intervention system from a surface vessel to a subsea tree.

2. Background

A subsea well intervention system includes a subsea intervention package connected to the subsea tree and a spoolable compliant guide (SCG) that will link the vessel to the subsea intervention package and allow conveyance of the intervention tools into the wellbore. The subsea intervention package, including the emergency disconnection package, the lubricator and the upper and lower intervention packages, is usually deployed from the vessel to the tree using guide wires. Some sections of the SCG are made buoyant by construction in order to provide a shape for allowing structural compliance when exposed to the environmental effects of the waves and current. Therefore, it requires a dead weight to be lowered to the seabed in a usually congested area, for its bottom connector extremity to be lowered through the water column. It also requires additional installation aids (e.g., remotely operated vehicle (ROV), Active Heave Compensation, winch, buoyancy, guide wires, etc.) and critical path time to align the bottom connector with the lubricator, and make-up and test the subsea connection.

U.S. Pat. No. 4,730,677 describes a method and system for maintaining and servicing subsea well. The system utilizes a flexible riser to link the surface vessel to the X-mas tree. The lower intervention package only is connected on surface to the flexible riser. However, the means of deployment is via the flexible riser powered reel, and the weight of the intervention package applied to the flexible riser is controlled via buoyancy modules attached to the lower intervention package. For deep water, the structure of the flexible riser will require several layers of armor wires and therefore the weight of the flexible riser will increase rapidly with the water depth. The application of this deployment method may therefore be limited in terms of water depth, for example, as:

The buoyancy required along the flexible riser will increase significantly with the weight of the flexible.

The tension capacity of a typical powered reel is limited to approximately 25 Te.

The flexible riser has a limited crushing resistance on the reel when submitted to high tension loads.

SUMMARY OF THE INVENTION

Therefore, there is a need for a method and apparatus (which also may be referred to herein as a "system") that addresses discovered problems with existing systems and methods for deploying a subsea well intervention system from a surface vessel to a subsea tree. The above and other needs and problems are addressed by the present invention, exemplary embodiments of which are presented in connection with the associated figures. The present invention provides an improved method and system that deploys the subsea intervention package and a spoolable compliant guide (SCG) in a single stage, thus improving efficiency of the overall operations by saving the requirement for a separate dead weight and the associated seabed real estate, and saving the subsea operations time for alignment, connection and testing.

Advantageously, the novel method and system need not rely on the buoyancy installed on the SCG or on the intervention package nor the tension/crushing capacity of the SCG for the deployment. Limitation in terms of water depth is solely dependant on the crane capacity to lift and lower the intervention package to the seabed. In the method for deployment of the SCG together with the subsea intervention package, the SCG is connected to the intervention package on the vessel deck and the connection is therefore tested on the surface. Then, the intervention package is sent either overboard or through the moonpool and lowered into the water column using a primary lifting device (e.g., a winch, a crane, etc.) in such a way that the SCG does not see the weight of the intervention package at any time. The SCG is gradually paid out from its reel as the intervention package is lowered to the seabed. The laying process of the SCG from the reel includes a reel drive unit, but may also be supplemented by a tensioner depending on the tension in the SCG due to the water depth. The weight of the intervention package is then transferred to the secondary lifting device (e.g., a crane, winch, etc.) and used as a dead weight to overcome the positive buoyancy of the SCG. The distance between the two lifting devices helps in creating and controlling the SCG shape. Once landed onto the subsea tree with heave compensation, the secondary lifting device is disconnected from the subsea intervention package, and the SCG is hung off at the vessel deck level and the system is ready to be operated. The novel system and method of deployment has the following benefits, including time saving versus the conventional two-stage deployment (e.g., intervention package first and then guide) by removing the attachment and recovery of a dead weight, and the performance of a subsea connection, better reliability of the SCG/intervention package connection as it is performed on surface and can be readily trouble shot if necessary, and reduction of the risks of damage to subsea facilities (e.g., tree, manifold, flying leads, umbilicals, flowlines, etc.), as the requirement to lower a dead weight to the seabed in usually congested areas is removed.

In an exemplary aspect, there is provided a method, system and apparatus for deploying a subsea well intervention system from a surface vessel to a subsea tree, including connecting a spoolable compliant guide (SCG) to a subsea intervention package on deck of a vessel; testing the connection on the deck of the vessel; lowering overboard the intervention package into a water column using a primary lifting device, including a winch or a crane, in such a way that the SCG does not see a weight of the intervention package; gradually paying out the SCG from a reel thereof as the intervention package is lowered to a seabed; transferring the weight of the intervention package to a secondary lifting device, including a winch or a crane, wherein the intervention package functions as a dead weight to overcome a positive buoyancy of the SCG, a distance between the primary and secondary lifting devices creates and controls a shape of the SCG; and once landed onto a subsea tree with heave compensation, disconnecting the secondary lifting device from the intervention package, and hanging the SCG off at the vessel at deck level.

Still other aspects, features, and advantages of the present invention are readily apparent from the entire description thereof, including the figures, which illustrate a number of exemplary embodiments and implementations. The present invention is also capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The embodiments of the present invention are illustrated by way of example, and not by way of limitation, in the figures of the accompanying drawings and in which like reference numerals refer to similar elements and in which.

DETAILED DESCRIPTION

Figure 1:
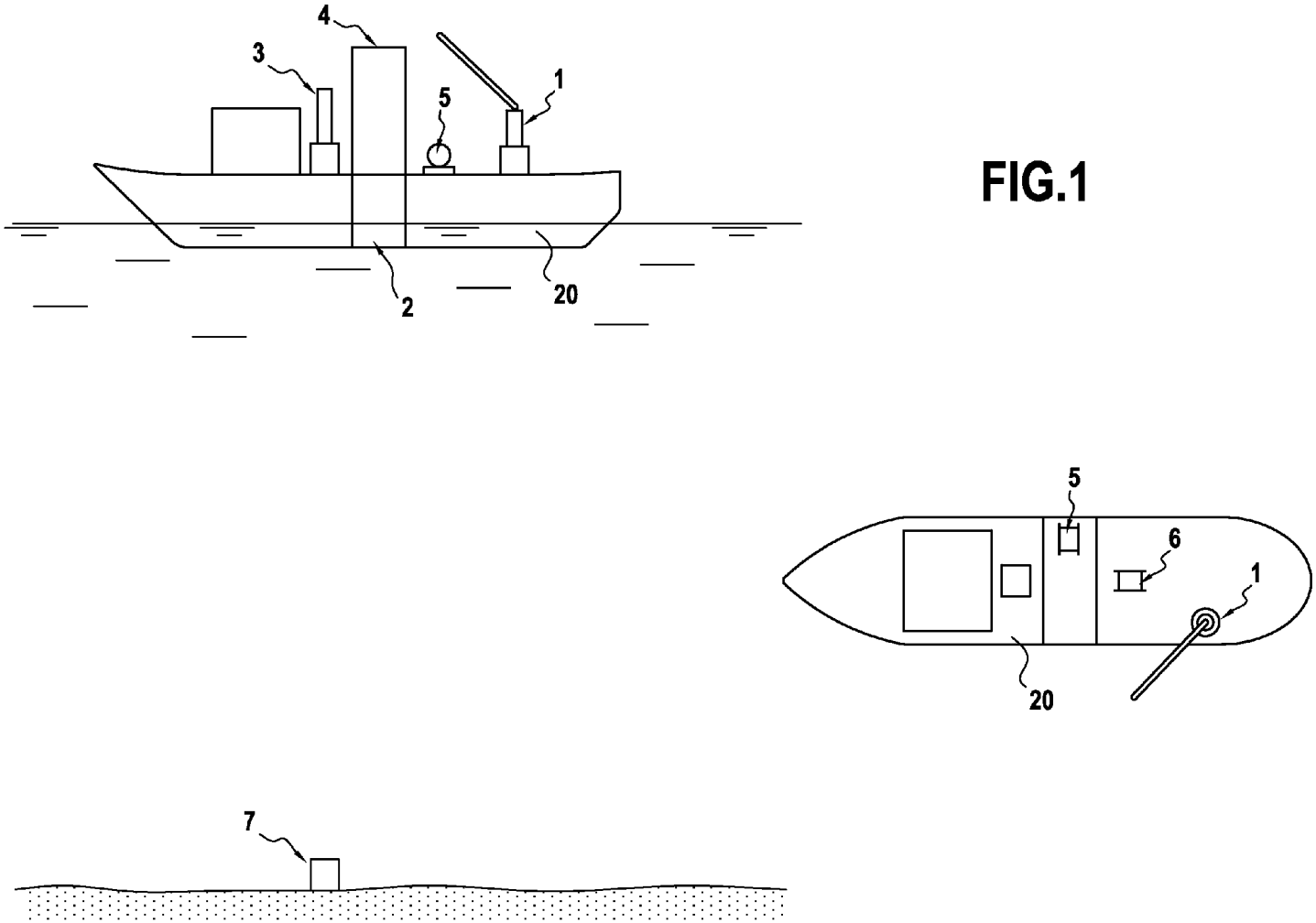
FIG. 1 illustrates typical equipment layout on board a vessel.

Various embodiments and aspects of the invention will now be described in detail with reference to the accompanying figures. The terminology and phraseology used herein is solely used for descriptive purposes and should not be construed as limiting in scope. Language such as "including," "comprising,""having," "containing," or "involving," and variations thereof, is intended to be broad and encompass the subject matter listed thereafter, equivalents, and additional subject matter not recited.

Referring now to the drawings, wherein like reference numerals designate identical or corresponding parts throughout the several views, and more particularly to FIGS. 1-9 thereof, there are illustrated an exemplary method and system for deploying a subsea well intervention system from a surface vessel to a subsea tree, according to exemplary aspects of the present invention.

In FIGS. 1-9, the subsea well intervention system includes an intervention package 3 and a spoolable compliant guide 8 (SCG) fitted with buoyancy modules 12 or continuous buoyancy. The vessel 20 is equipped with dynamic positioning and two handling devices: a deployment winch 6 and a crane 1, and a reel 5 including the SCG. The illustration in FIG. 1 shows the vessel fitted with a moonpool 2, but a similar procedure could be used with an alternative vessel configuration, including two handling/lifting devices over the side of the vessel, or one device over the side and one over the stem of the vessel.

The Spoolable Compliant guide is described in patents U.S. Pat. Nos. 6,386,290, 683,724, 6,691,775, and 6,745,840 and in patent applications US20080314597A1, US20080185153A1, US2008185152A1, WO2009053022A2, WO2008118680A1 and WO200122577A2 all assigned to the same assignee as the present invention and which are incorporated herein by reference for all purposes allowed and to the extent that their disclosure does not contradict the specific disclosure and claims of the present invention. The Spoolable Compliant Guide can be made of a continuous pipe, however preferably it is made of a combination of continuous flexible pipe and drill pipe. In one embodiment the drill pipe part of the guide is the lower part of the guide, the one that connects to the X-mas tree and the upper part is made of a continuous flexible pipe such as coiled tubing. However, as it will be appreciated by a person skilled in this art the methodology and system described in this application are equally applicable to many different guide constructions.

Figure 2:
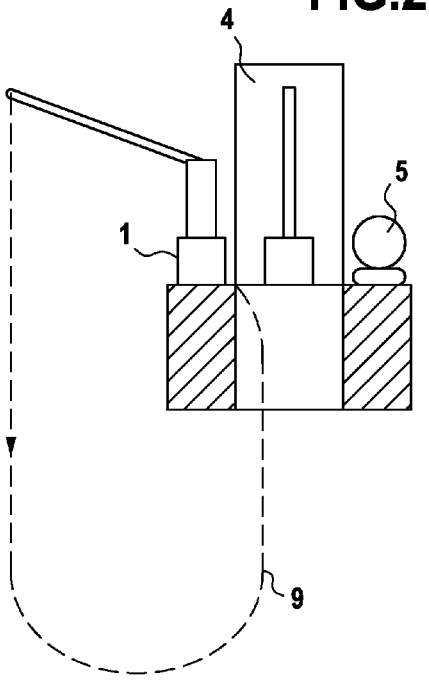
FIG. 2 illustrates an intervention package skidded over a moonpool.
Figure 3:
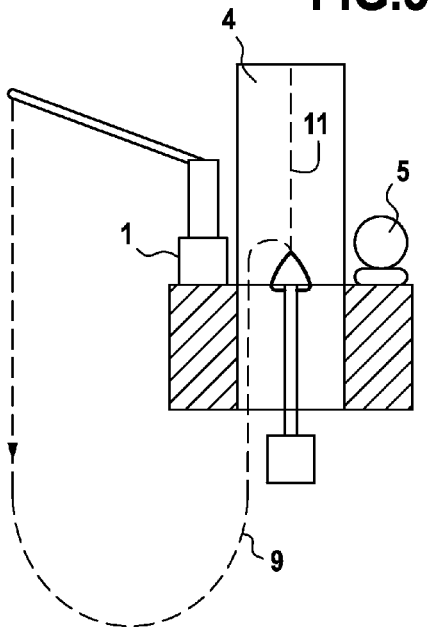
FIG. 3 illustrates a deployment winch wire connected to an intervention package via a lifting frame with the intervention package lowered into a moonpool.
Figure 4:
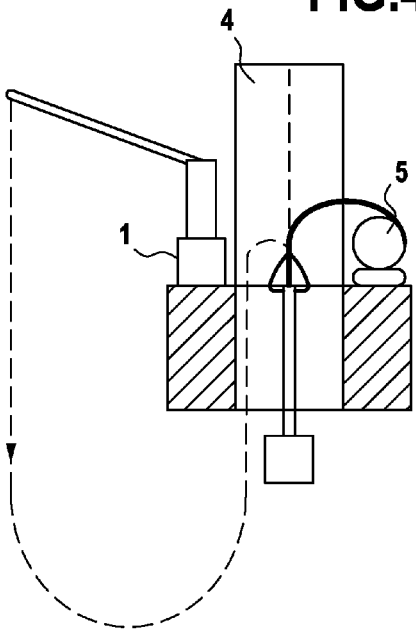
FIG. 4 illustrates a spoolable compliant guide (SCG) being paid out from a powered reel thereof and connected to a top of an intervention package on a deck of a vessel.
Figure 5:
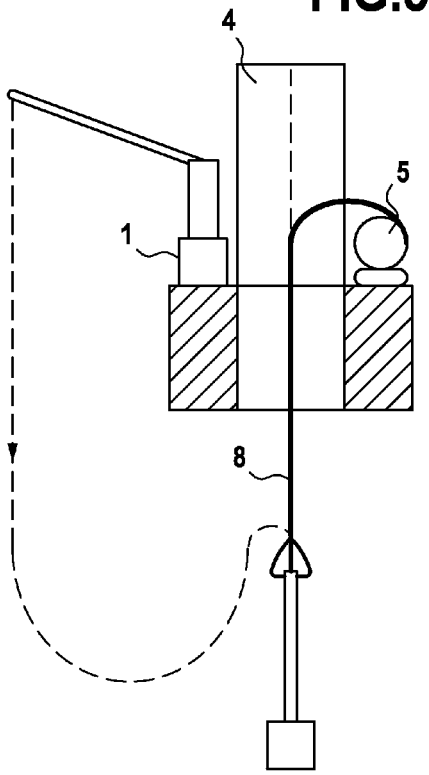
FIG. 5 illustrates a deployment winch lowering an intervention package into water, while a SCG is paid out from a reel thereof and a crane hook lowered into the water, so that the weight of the intervention package is solely taken up by the deployment winch.
Figure 6:
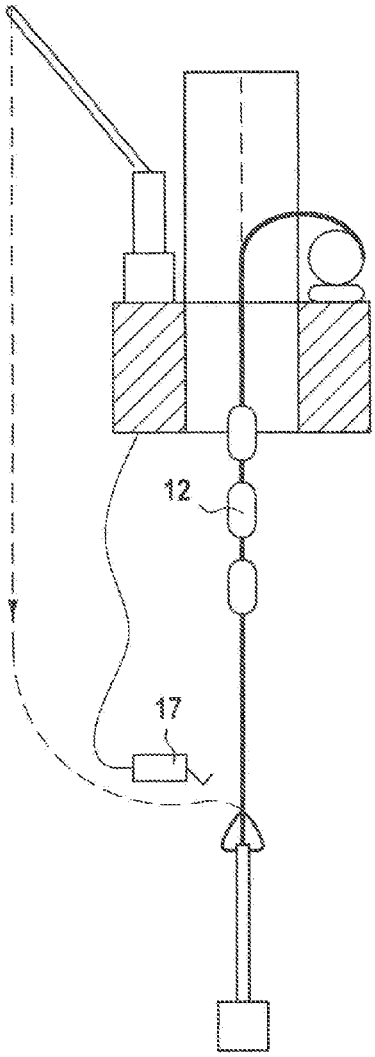
FIG. 6 illustrates a buoyancy module attached to a SCG as required and a paying out rate of the SCG defined such that a shape of the SCG is controlled.
Figure 7:
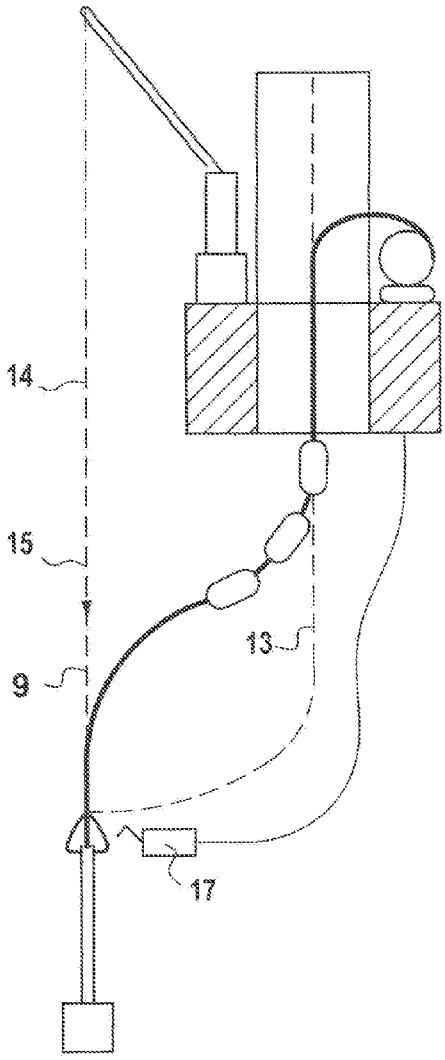
FIG. 7 illustrates a deployment winch wire being disconnected from an intervention package by a remotely operated vehicle (ROV)
Figure 9:
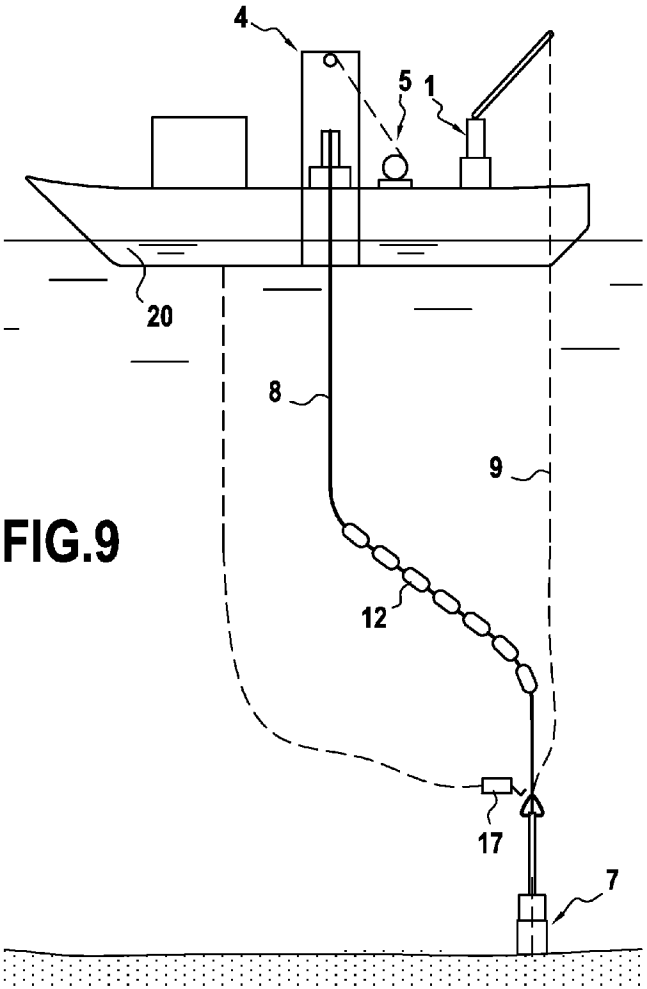
FIG. 9 illustrates a crane pennant being disconnected from an intervention package.
Figure 8:
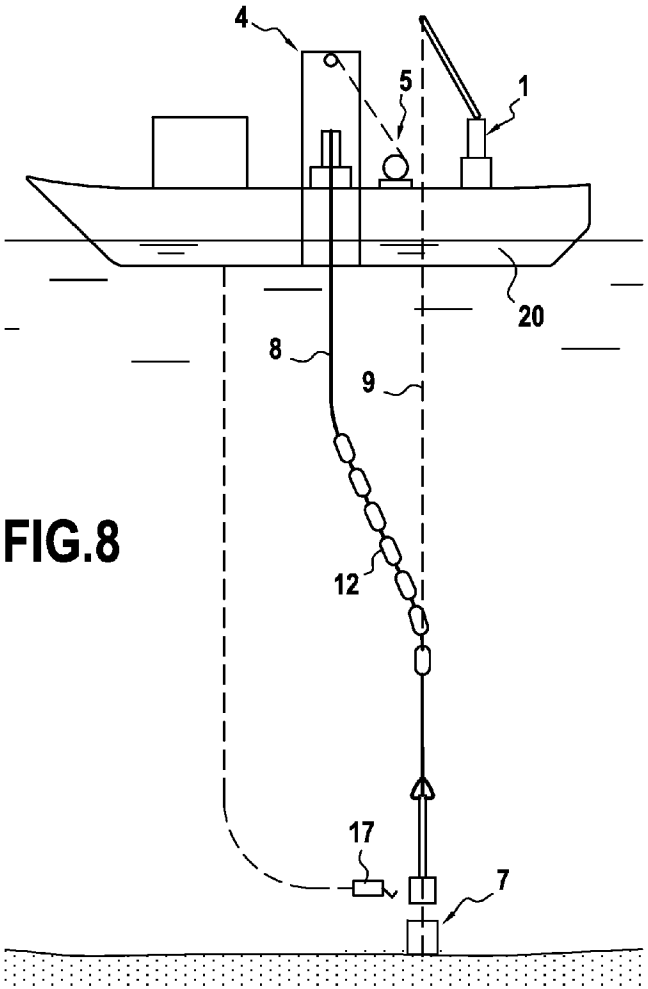
FIG. 8 illustrates an intervention packages being lowered into a water column down to a X-mas tree using a crane with crane position adjusted so that a SCG shape in a buoyancy section remains controlled.

The deployment methodology is described as follows, wherein typical equipment layout onboard the vessel is shown on FIG. 1. A pennant wire is connected to the crane hook 15 and cross-hauled in the vessel moonpool 2. The intervention package 3 is skidded over the moonpool 2 as shown in FIG. 2. The deployment winch wire 11 is connected to the intervention package 3 via a lifting frame 4, if required, and the intervention package 3 is lowered into the moonpool 2 as shown in FIG. 3. The SCG 8 is paid out from its powered reel 5 and connected to the top of the intervention package 3 on the vessel deck as shown in FIG. 4 and the connection is tested immediately. The deployment winch 11 lowers the package 3 into the water, while the SCG 8 is paid out from its reel 5 and the crane hook 15 lowered into the water, so that the weight of the intervention package 3 is solely taken by the deployment winch 11 as shown in FIG. 5. Buoyancy modules 12 are attached to the SCG 8, as required, and the pay out rate of the SCG 8 is defined, such that the shape of the SCG 8 is controlled (refer to FIG. 6). Once sufficiently lowered into the water, the weight of the intervention package 3 is gradually transferred to the crane pennant 9 by paying out on the deployment winch 11 and picking up on the crane wire 14. The transfer is monitored by a remotely operated vehicle (ROV) 17 and the transfer parameters, such that the shape of the SCG remains controlled by the weight of the intervention package 3. The deployment winch wire 13 is then disconnected from the intervention package by ROV 17 as shown in FIG. 7. The intervention package 3 is lowered into the water column down to the x-mas tree 7 using the crane 1 and the crane position is adjusted (e.g., radius, orientation, etc.), so that the SCG shape in the buoyancy section remains controlled as shown in FIG. 8. The intervention package is landed onto the X-mas tree using the crane using heave compensation. The connection between the intervention package and the x-mas trees is a typical industry subsea connector, energized either by a running tool or by ROV. The crane pennant 9 is then disconnected from the intervention package 3 (see FIG. 9). The vessel 20 can then move to a predetermined offset from the x-mas tree to achieve the required SCG shape.

While the present inventions have been described in connection with a number of exemplary embodiments, and implementations, the present inventions are not so limited, but rather cover various modifications, and equivalent arrangements, which fall within the purview of the appended claims.

What is claimed is:

1. A method for deploying a subsea well intervention system from a single surface vessel to a subsea tree, comprising:

connecting a spoolable compliant guide (SCG) to a subsea intervention package on a deck of the vessel;

testing the connection on the deck of the vessel;

lowering the intervention package into a water column using a primary lifting device disposed on the surface vessel, including a winch or a crane, such that the SCG does not support a weight of the intervention package;

gradually paying out the SCG from a reel thereof as the intervention package is lowered to a seabed;

transferring the weight of the intervention package to a secondary lifting device disposed on the surface vessel, including a winch or a crane, wherein the intervention package functions as a dead weight to overcome a positive buoyancy of the SCG, a distance between the primary and secondary lifting devices creates and controls a shape of the SCG; and once landed onto the subsea tree with heave compensation, disconnecting the secondary lifting device from the intervention package, and hanging the SCG off at the vessel at deck level.

2. A system corresponding to the method of claim 1.

3. An apparatus corresponding to the method of claim 1.

4. A method for deploying a subsea well intervention system from a single surface vessel to a subsea tree, comprising:

connecting a spoolable compliant guide (SCG) to a subsea intervention package at a surface;

lowering the intervention package into a water column using a primary lifting device disposed on the surface vessel, such that the intervention package is mainly supported by the primary lifting device;

lowering the intervention package toward a seabed;

paying out the SCG as the intervention package is lowered to the seabed, wherein the intervention package functions as a dead weight to overcome a positive buoyancy of the SCG;

transferring the weight of the intervention package to a secondary lifting device disposed on the surface vessel, such that the intervention package is mainly supported by the secondary lifting device;

landing the intervention package on a subsea structure; and disconnecting the secondary lifting device from the intervention package.

5. The method of claim 4, further including hanging the SCG off the vessel.

6. The method of claim 4, wherein lowering the intervention package into a water column includes lowering the intervention package with one of a crane and a winch.

7. The method of claim 4, further including lowering the intervention package to the seabed with the secondary lifting device.

8. The method of claim 7, wherein lowering the intervention package to the seabed includes lowering the intervention package with one of a crane and a winch.

9. The method of claim 4, further including decoupling the primary lifting device from the intervention package.

10. The method of claim 4, wherein lowering the intervention package toward a seabed includes lowering the intervention package through a moonpool.

11. A method for deploying a subsea well intervention package from a single surface vessel to a subsea structure, comprising:

connecting a compliant guide to a subsea intervention package, wherein the compliant guide includes at least one buoyancy module;

lowering the intervention package into a sea using a first lifting device disposed on the surface vessel, such that the intervention package is only supported by the first lifting device;

lowering the intervention package toward a seabed with the first lifting device;

paying out the compliant guide as the intervention package is lowered toward the seabed, wherein the intervention package functions as a dead weight to overcome a positive buoyancy of the compliant guide;

transferring the weight of the intervention package from the first lifting device to a secondary lifting device disposed on the surface vessel, while the intervention package is disposed directly under the vessel;

decoupling the primary lifting device from the intervention package;

lowering the intervention package toward the seabed with the secondary lifting device;

landing the intervention package on the subsea structure; and disconnecting the secondary lifting device from the intervention package.

12. The method of claim 11, wherein the first lifting device is at a first location on the vessel and the secondary lifting device is at a second location on the vessel different from the first location, and wherein the distance between the first and second lifting devices creates and controls a shape of the compliant guide.

13. The method of claim 11, wherein lowering the intervention package toward a seabed includes lowering the intervention package through a moonpool.

* * * * *